US011097539B2

(12) United States Patent
Hirai et al.

(10) Patent No.: US 11,097,539 B2
(45) Date of Patent: Aug. 24, 2021

(54) LIQUID EJECTION HEAD

(71) Applicant: Brother Kogyo Kabushiki Kaisha, Nagoya (JP)

(72) Inventors: Keita Hirai, Nagoya (JP); Shohei Koide, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/860,231

(22) Filed: Apr. 28, 2020

(65) Prior Publication Data

US 2020/0376836 A1 Dec. 3, 2020

(30) Foreign Application Priority Data

Jun. 3, 2019 (JP) ..... JP2019-103639

(51) Int. Cl.
*B41J 2/14* (2006.01)

(52) U.S. Cl.
CPC ..... *B41J 2/14* (2013.01); *B41J 2002/14306* (2013.01); *B41J 2002/14419* (2013.01)

(58) Field of Classification Search
CPC ..... B41J 2/14; B41J 2002/14419; B41J 2002/14306; B41J 2/14233; B41J 2202/12
See application file for complete search history.

(56) References Cited

U.S. PATENT DOCUMENTS 9,987,854 B2 * 6/2018 Kobayashi ..... B41J 2/155
2017/0253037 A1 9/2017 Kobayashi
2018/0319162 A1 11/2018 Kobayashi et al.

FOREIGN PATENT DOCUMENTS

WO 2016-031920 A1 3/2016
WO 2017-073668 A1 5/2017

OTHER PUBLICATIONS

IP.com search (Year: 2021).*

* cited by examiner

*Primary Examiner* — Lisa Solomon
(74) *Attorney, Agent, or Firm* — Banner & Witcoff, Ltd.

(57) ABSTRACT

A liquid ejection head includes a supply manifold, a return manifold, a plurality of individual channels, and a connecting throttle channel. The supply manifold includes a supply port through which liquid is supplied from an exterior. The return manifold includes a return port through which liquid is discharged to the exterior. Each individual channel is connected, at an upstream end thereof, to the supply manifold and, at a downstream end thereof, to the return manifold. Each individual channel communicates with a corresponding one of nozzles and includes an individual throttle channel. Through the connecting throttle channel, adjacent ones of the individual throttle channels communicate with each other. The connecting throttle channel has a channel resistance less than or equal to a channel resistance of each individual throttle channel.

13 Claims, 7 Drawing Sheets

LIQUID EJECTION HEAD

CROSS-REFERENCE TO RELATED APPLICATION

This application claims priority from Japanese Patent Application No. 2019-103639 filed on Jun. 3, 2019, the content of which is incorporated herein by reference in its entirety.

TECHNICAL FIELD

Aspects of the disclosure relate to a liquid ejection head.

BACKGROUND

A known liquid ejection head includes a plurality of ejection units each including an ejection hole, a pressure chamber communicating with the ejection hole, a first channel for supplying liquid to the pressure chamber, and a second channel for collecting liquid from the pressure chamber.

The liquid ejection head further includes connecting channels each of which connects adjacent ejection units and is greater in channel resistance than each first channel and each second channel. The connecting channels are provided to reduce the possibility that a pressure wave leaks to a supply manifold and a return manifold which are common channels.

SUMMARY

However, in the known ejection head, each connecting channel is greater in channel resistance than each first channel as a supply throttle channel and each second channel as a return throttle channel. This may impede effective dispersion of the pressure wave. Consequently, the connecting channels may not sufficiently improve the stability in liquid ejection.

Aspects of the disclosure provide a liquid ejection head configured to sufficiently improve the stability in liquid ejection.

According to one or more aspects of the disclosure, a liquid ejection head includes a supply manifold, a return manifold, a plurality of individual channels, and a connecting throttle channel. The supply manifold includes a supply port through which liquid is supplied from an exterior. The return manifold includes a return port through which liquid is discharged to the exterior. The individual channels are each connected, at an upstream end thereof, to the supply manifold and, at a downstream end thereof, to the return manifold. Each of the individual channels communicates with a corresponding one of nozzles and includes an individual throttle channel. Through the connecting throttle channel, adjacent ones of the individual throttle channels communicate with each other. The connecting throttle channel has a channel resistance less than or equal to a channel resistance of each of the individual throttle channels.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Illustrative embodiments of the disclosure will be described with reference to the drawings. Liquid ejection heads to be described according to the illustrative embodiments are merely examples and not limited thereto. Various changes, additions, and deletions may be applied in the illustrative embodiments without departing from the spirit and scope of the disclosure.

First Illustrative Embodiment

<Structure of Liquid Ejection Apparatus>

A liquid ejection apparatus 10 including a liquid ejection head 20 head according to a first illustrative embodiment is configured to eject liquid, such as ink. Hereinafter, the liquid ejection apparatus 10 will be described by way of example as applied to, but not limited to, an inkjet printer.

Figure 1:
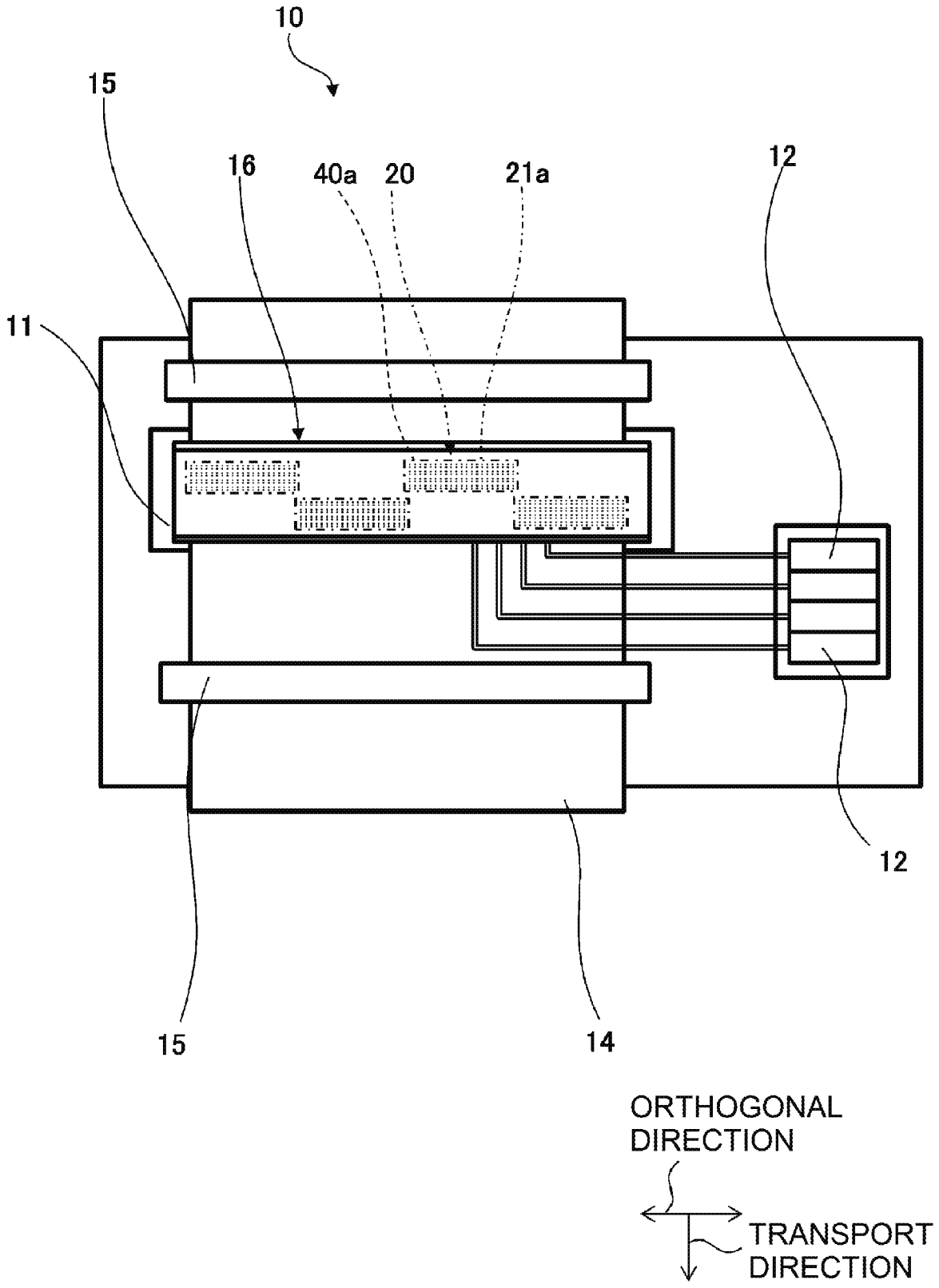
FIG. 1 is a plan view showing an overall structure of a liquid ejection apparatus including a liquid ejection head according to a first illustrative embodiment.

As shown in FIG. 1, the liquid ejection apparatus 10 employs a line head type and includes a platen 11, a transport unit, a head unit 16, and a tank 12. The liquid ejection apparatus 10 may employ a serial head type or other types than the line head type.

The platen 11 is a flat plate member to receive thereon a sheet 14 and adjust a distance between the sheet 14 and the head unit 16. Herein, one side of the platen 11 toward the head unit 16 is referred to as an upper side, and the other side of the platen 11 away from the head unit 16 is referred to as a lower side. However, the liquid ejection apparatus 10 may be positioned in other orientations.

The transport unit may include two transport rollers 15 and a transport motor (not shown). The two transport rollers 15 are connected to the transport motor and disposed parallel to each other in a direction (an orthogonal direction) orthogonal to a transport direction of the sheet 14 while interposing the platen 11 therebetween. When the transport motor is driven, the transport rollers 15 rotate to transport the sheet 14 on the platen 11 in the transport direction.

The head unit 16 has a length greater than or equal to the length of the sheet 14 in the orthogonal direction. The head unit 16 includes a plurality of liquid ejection heads 20.

Each liquid ejection head 20 includes a stack structure including a channel unit and a volume changer. The channel unit includes liquid channels formed therein and a plurality of nozzle holes 21*a* open on its lower surface as an ejection surface 40*a*. The volume changer is driven to change the volume of a liquid channel. In this case, a meniscus in a nozzle hole 21*a* vibrates and liquid is ejected from the nozzle hole 21*a*. The ink ejection head 20 will be described in detail later.

Separate tanks 12 are provided for different kinds of inks. For example, each of four tanks 12 stores therein a corresponding one of black, yellow, cyan, and magenta inks. Inks of the tanks 12 are supplied to corresponding nozzle holes 21*a*.

<Structure of Liquid Ejection Head>

Figure 2:
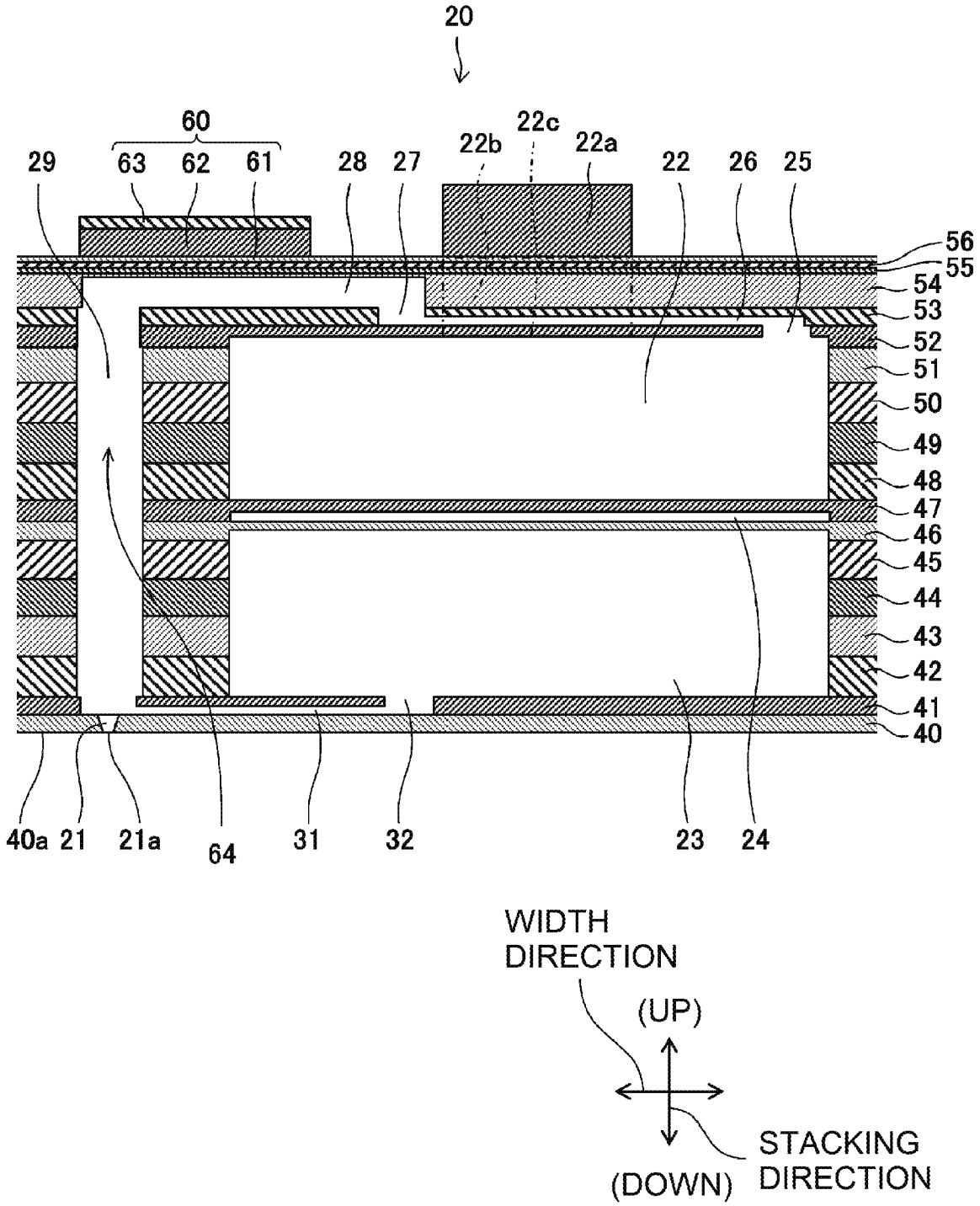
FIG. 2 is a cross-sectional view of the liquid ejection head of FIG. 1 taken along a line orthogonal to an array direction.

As described above, each liquid ejection head 20 includes the channel unit and the volume changer. As shown in FIG. 2, the channel unit is formed by a stack of a plurality of plates, and the volume changer includes a vibration plate 55 and piezoelectric elements 60.

The plurality of plates include a nozzle plate 40, a first channel plate 41, a second channel plate 42, a third channel plate 43, a fourth channel plate 44, a fifth channel plate 45, a sixth channel plate 46, a seventh channel plate 47, an eighth channel plate 48, a ninth channel plate 49, a 10th channel plate 50, an 11th channel plate 51, a 12th channel plate 52, a 13th channel plate 53, and a 14th channel plate 54. These plates are stacked in this order in a stacking direction.

Each plate has holes and grooves of various sizes. A combination of holes and grooves in the stacked plates of the channel unit defines liquid channels such as a plurality of nozzles 21, a plurality of individual channels, a supply manifold 22, and a return manifold 23.

The nozzles 21 are formed to penetrate the nozzle plate 40 in the stacking direction. Nozzle holes 21*a*, which are ends of the nozzles 21, are arranged as a nozzle array in an array direction on the ejection surface 40*a* of the nozzle plate 40. The array direction is orthogonal to the stacking direction.

The supply manifold 22 extends in the array direction and is connected to one end of each individual channel 64. The return manifold 23 extends in the array direction and is connected to the other end of each individual channel 64. The supply manifold 22 is stacked on the return manifold 23. The supply manifold 22 and the return manifold 23 overlap each other in the stacking direction.

The cross-sectional area of the supply manifold 22 is substantially equal to the cross-sectional area of the return manifold 23. For example, the supply manifold 22 and the return manifold 23 may be the same in size and shape. In this case, the supply manifold 22 and the return manifold 23 may have the same dimensions in the array direction, in a width direction, and in the stacking direction. For example, each of the manifolds 22 and 23 has a cross-sectional area of 1000 $\mu m^2$ or more and 2000 $\mu m^2$ or less.

The supply manifold 22 is formed by through-holes penetrating in the stacking direction the eighth channel plate 48 through the 11th channel plate 51, and a recess recessed from a lower surface of the 12th channel plate 52. The recess overlaps the through-holes in the stacking direction. A lower end of the supply manifold 22 is covered by the seventh channel plate 47, and an upper end of the supply manifold 22 is covered by an upper portion of the 12th channel plate 52.

The return manifold 23 is formed by through-holes penetrating in the stacking direction the second channel plate 42 through the fifth channel plate 45, and a recess recessed from a lower surface of the sixth channel plate 46. The recess overlaps the through-holes in the stacking direction. A lower end of the return manifold 23 is covered by the first channel plate 41, and an upper end of the return manifold 23 is covered by an upper portion of the sixth channel plate 46.

The supply manifold 22 and the return manifold 23 define a damper 24 as a buffer space therebetween. The damper 24 is formed by a recess recessed from a lower surface of the seventh channel plate 47. In the stacking direction, the supply manifold 22 and the damper 24 are adjacent to each other via an upper portion of the seventh channel plate 47, and the return manifold 23 and the damper 24 are adjacent to each other via the upper portion of the sixth channel plate 46. The damper 23 sandwiched between the supply manifold 22 and the return manifold 23 may reduce interaction between the liquid pressure in the supply manifold 22 and the liquid pressure in the return manifold 23.

Figure 3:
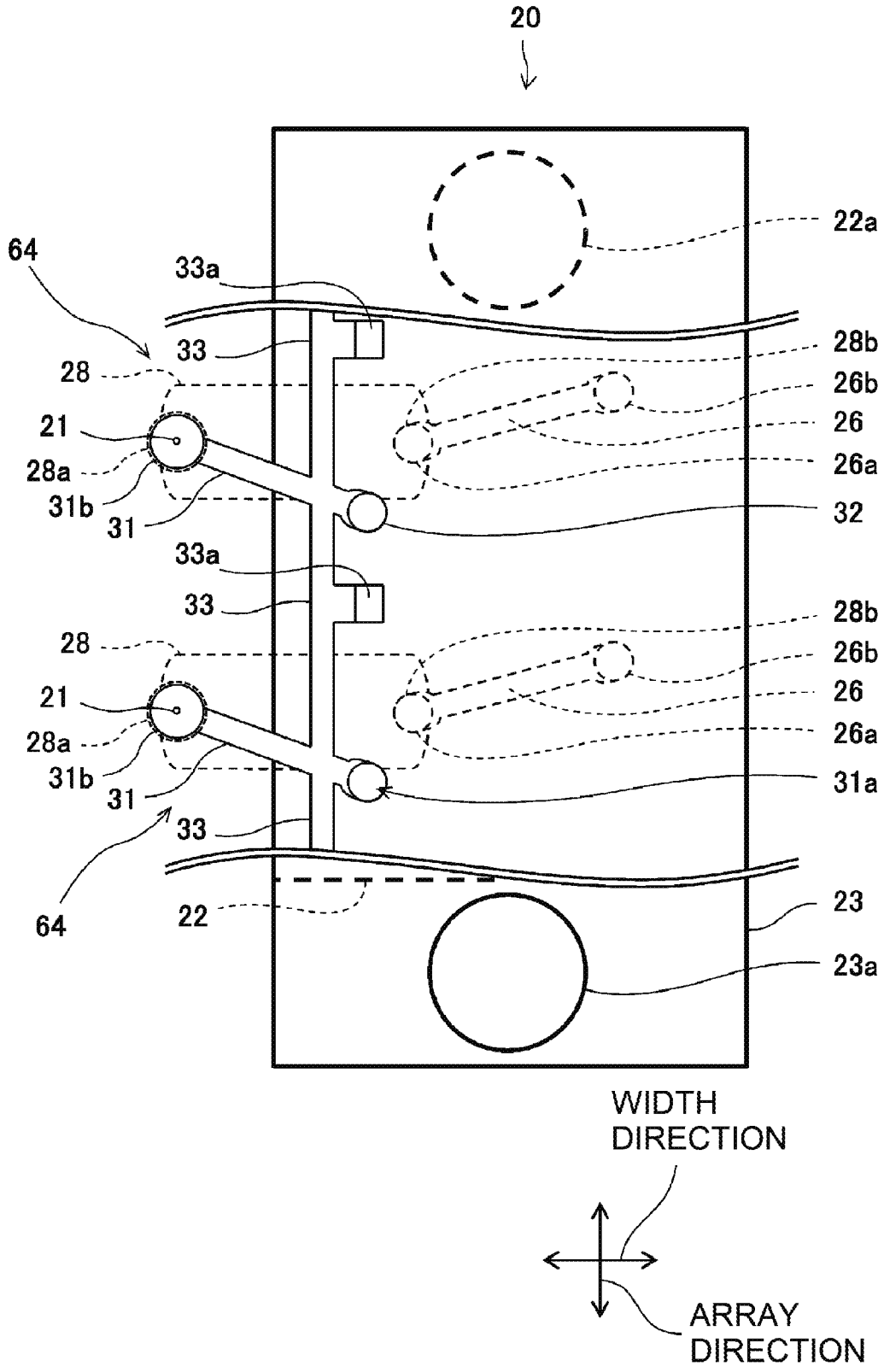
FIG. 3 is a plan view of the liquid ejection head of FIG. 1, showing a positional relation of manifolds, supply throttle channels, return throttle channels, and connecting throttle channels.

The supply manifold 22 includes a supply opening 22*c* at its one end in the array direction (an end on an upper side of the drawing sheet of FIG. 3). In this embodiment, a supply passage 22*b* is connected, at its lower end, to the supply opening 22*c* and extends upward from the supply opening 22*c*. For example, the supply passage 22*b* penetrates an upper portion of the 12th channel plate 52, the 13th channel plate 53, the 14th channel plate 54, the vibration plate 55, and an insulating film 56. An upper end of the supply passage 22*b* is connected to an inner space of a cylindrical supply port 22*a*.

The return manifold 23 includes a return port 23*a* at its other end in the array direction (an end on a lower side of the drawing sheet of FIG. 3). The return port 23*a* is connected to a lower end of a return passage (not shown). The return passage extends upward from the return port 23*a*. For example, the return passage penetrates the sixth channel plate 46 through the vibration plate 55. An upper end of the return passage is connected to an inner space of a cylindrical return port 23*a*. For example, the return port 23*a* is located further to the other end in the array direction than a downstream end of the supply manifold 22.

The plurality of individual channels 64 are connected to the supply manifold 22 and to the return manifold 23. Each individual channel 64 is connected, at its upstream end, to the supply manifold 22, connected, at its downstream end, to the return manifold 23, and connected, at its midstream, to a base end of a corresponding nozzle 21. Each individual channel 64 includes a first communication hole 25, a supply throttle channel 26 as an individual throttle channel, a second communication hole 27, a pressure chamber 28, a descender 29, a return throttle channel 31 as an individual throttle channel, and a third communication hole 32, which are arranged in this order.

The first communication hole 25 is connected, at its lower end, to an upper end of the supply manifold 22, and extends upward from the supply manifold 22 in the stacking direction to penetrate an upper portion of the 12th channel plate 52 in the stacking direction. The first communication hole 25 is offset to one side (a right side in FIG. 2) from a center of the supply manifold 22 in the width direction.

One end 26*b* of the supply throttle channel 26 is connected to an upper end of the first communication hole 25. The supply throttle channel 26 is formed, for example by half-etching, as a groove recessed from a lower surface of the 13th channel plate 53. The supply throttle channel 26 is located to cross the width direction in plan view. An angle between an extending direction of the supply throttle channel 26 and the width direction is set to be greater than 0° and less than 90°. The second communication hole 27 is connected, at its lower end, to the other end 26*a* of the supply throttle channel 26, and extends from the supply throttle channel 26 upward in the stacking direction to penetrate an upper portion of the 13th channel plate 53 in the stacking direction. The second communication hole 27 is offset to the other side (a left side in FIG. 2) from the center of the supply manifold 22 in the width direction.

The pressure chamber 28 is connected, at its one end 28*b*, to an upper end of the second communication hole 27. The pressure chamber 28 penetrates the 14th channel plate 54 in the stacking direction.

The descender 29 penetrates the first channel plate 41 through the 13th channel plate 53 in the stacking direction and is located further to the other side (the left side in FIG. 2) in the width direction than the supply manifold 22 and the return manifold 23. The descender 29 is connected, at its upper end, to the other end 28*a* of the pressure chamber 28, and is connected, at its lower end, to the nozzle 21. For example, the nozzle 21 is located to overlap the descender 29 in the stacking direction and is located at a center of the descender 29 in a direction orthogonal to the stacking direction. The descender 29 may have a cross-sectional area which is uniform or varies in the stacking direction. For example, an upper portion (defined by the 12th channel plate 52 and the 13th channel plate 53) of the descender 29 may have a cross-sectional area which decreases toward the upper end.

The return throttle channel 31 is connected, at its one end 31*b*, to a lower end of the descender 29. The return throttle channel 31 is formed, for example by half-etching, as a groove recessed from a lower surface of the first channel plate 41. The return throttle channel 31 is located to cross the width direction in plan view. An angle between an extending direction of the return throttle channel 31 and the width direction is set to be greater than 0° and less than 90°.

The third communication hole 32 is connected, at its lower end, to the other end 31*a* of the return throttle channel 31 and extends from the return throttle channel 31 upward in the stacking direction to penetrate an upper portion of the first channel plate 41 in the stacking direction. The third communication hole 32 is connected, at its upper end, to a lower end of the return manifold 23. The third communication hole 32 is offset to the other side (the left side in FIG. 2) from the center of the return manifold 23 in the width direction.

In this embodiment, as shown in FIG. 3, the liquid ejection head 20 includes connecting throttle channels 33 through each of which corresponding adjacent return throttle channels 31 communicate with each other. The connecting throttle channels 33 extend in the array direction. Through a connecting throttle channel 33, adjacent return throttles 31 communicate with each other so as to have the same channel resistance. Specifically, through the connecting throttle channel 33, portions of adjacent return throttle channels 31 communicate with each other. Each portion is offset from a center of the return throttle channel 31 toward the other end 31*a* in a longitudinal direction. In other words, through the connecting throttle channel 33, downstream end portions of adjacent return throttle channels 31 communicate with each other.

Each connecting throttle channel 33 has a channel resistance less than or equal to the channel resistance of each return throttle channel 31. The channel resistance refers to a resistance per a unit length of a channel. The channel resistance is, for example, a channel cross-sectional area and indicates the fluidity of liquid in a channel. In this case, each connecting throttle channel 33 has a channel cross-sectional area less than or equal to the channel cross-sectional area of each return throttle channel 31. In this embodiment, each connecting throttle channel 33 and each return throttle channel 31 have the same channel cross-sectional area.

Such connecting throttle channels 33 are formed by the same process for the return throttle channels 31. The connecting throttle channels 33 are formed in a half-etched plate. Thus, the connecting throttle channels 33 and the return throttle channels 31 have the same depth. This prevents formation of a step in a depth direction between a connecting throttle channel 33 and a return throttle channel 31.

Each connecting throttle channel 33 has a communication port 33*a* connected to the return manifold 23. The communication port 33*a* is located on one side (a right side in FIG. 3) of each connecting throttle channel 33 and is connected to the return manifold 23 by penetrating an upper portion of the first channel plate 41 upward in the stacking direction. The communication port 33*a* is located on an upper side in the array direction of each connecting throttle channel 33 in the drawing sheet of FIG. 3.

Figure 4:
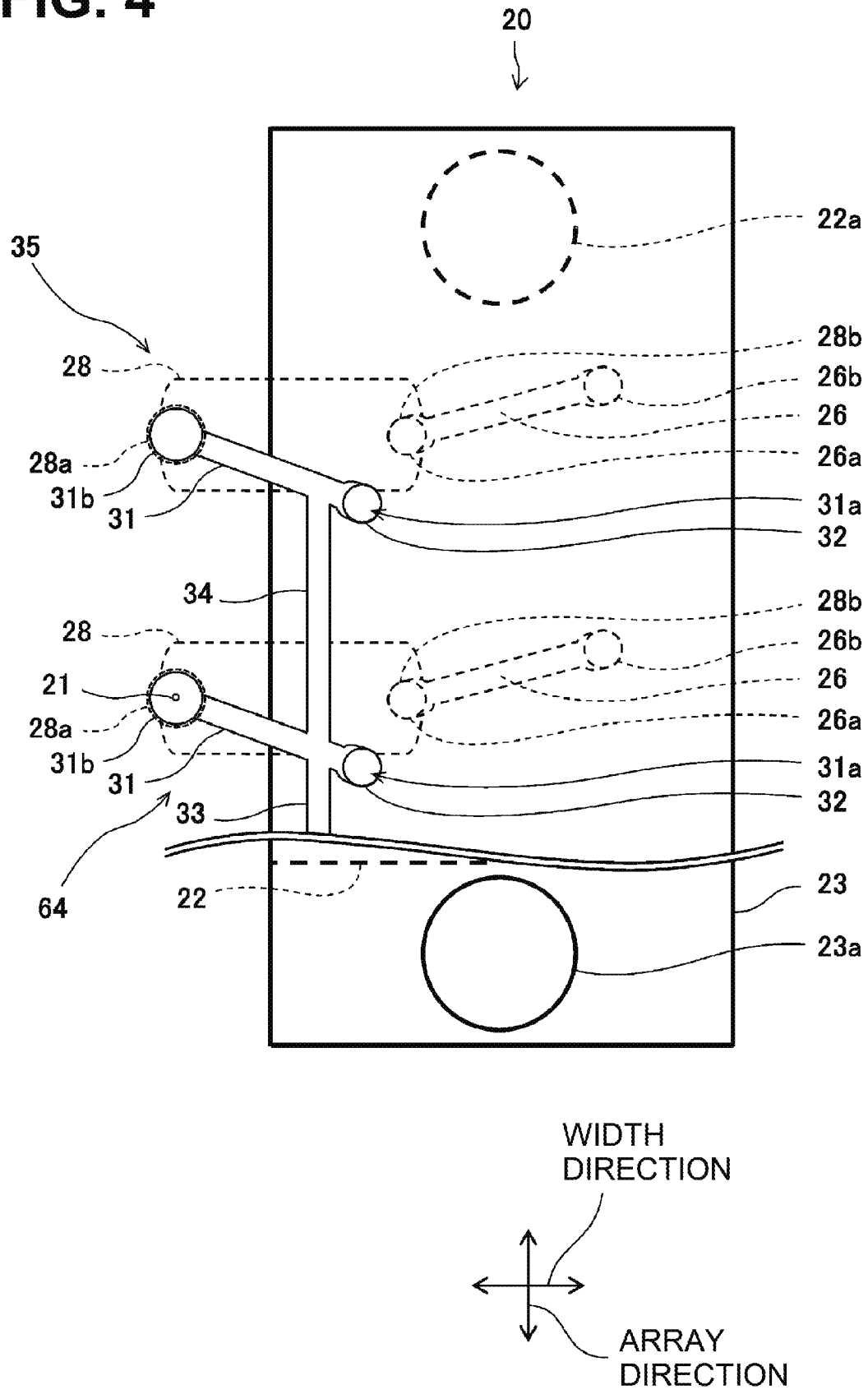
FIG. 4 is a plan view of the liquid ejection head of FIG. 1, showing a dummy connecting throttle channel through which a dummy individual throttle channel and a return throttle channel located at an end of a nozzle array.
Figure 5:
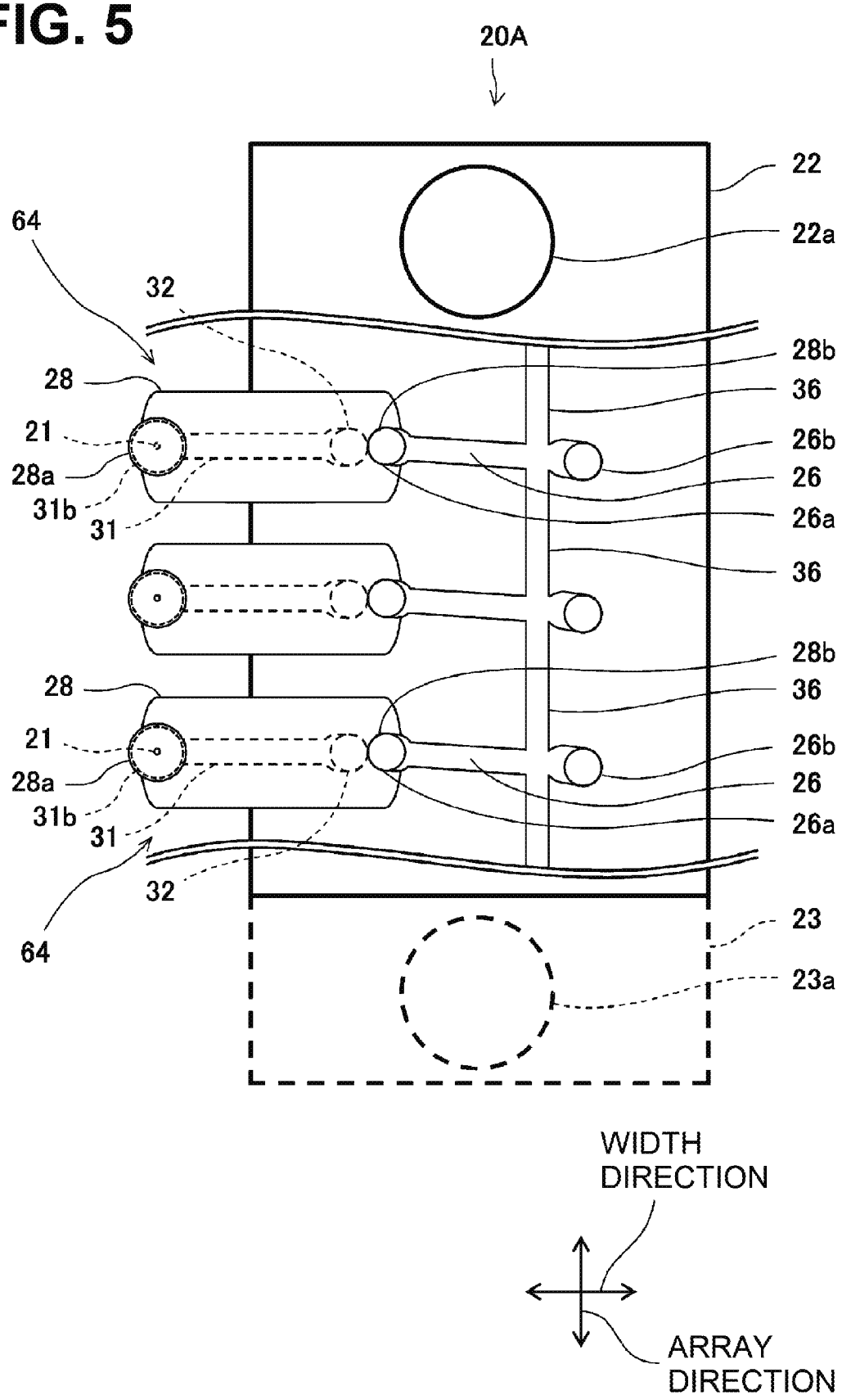
FIG. 5 is a plan view of a liquid ejection head according to a second illustrative embodiment, showing a positional relation of manifolds, supply throttle channels, return throttle channels, and connecting throttle channels.

As shown in FIG. 4, the liquid ejection head 20 in this embodiment includes a dummy individual channel 35 which is not connected to a nozzle. The dummy individual channel 35 is located next to a corresponding one of the individual channels 64 located at opposite ends in the array direction. The dummy individual channel 35 is connected to the supply manifold 22 and to the return manifold 23. The dummy individual channel 35 is connected, at its upstream end, to the supply manifold 22 and, at its downstream end, to the return manifold 23. Unlike the individual channels 64, the dummy individual channel 35 is not connected to a nozzle.

The dummy individual channel 35 has the same structure as the individual channels 64 except that the dummy individual channel 35 is not connected to a nozzle. The dummy individual channel 35 includes a first communication hole 25, a supply throttle channel 26, a second communication hole 27, a pressure chamber 28, a descender 29, a return throttle channel 31, and a third communication hole 32, which are arranged in this order. In the dummy individual channel 35, liquid flowing from the supply manifold 22 to the supply throttle channel 26 is returned to the return manifold 23 for circulation, without being discharged from a nozzle.

Such a structure includes a dummy connecting throttle channel 34 through which the return throttle channel 31 of the individual channel 64 and the return throttle channel (a dummy individual throttle channel) 31 of the dummy individual channel 35, which are adjacent to each other, communicate with each other. The dummy connecting throttle channel 34 extends in the array direction. Through the dummy connecting throttle channel 34, adjacent return throttle channels 31 communicate with each other so as to have the same channel resistance. Specifically, through the dummy connecting throttle channel 34, portions of adjacent return throttle channels 31 communicate with each other. Each portion is offset from a center of the return throttle channel 31 toward the other end 31*a* in a longitudinal direction. In other words, through the dummy connecting throttle channel 34, downstream end portions of adjacent return throttle channels 31 communicate with each other.

The dummy connecting throttle channel 34 has a channel resistance less than or equal to the channel resistance of each return throttle channel 31. The dummy connecting throttle channel 34 has a channel cross-sectional area less than or equal to the channel cross-sectional area of each return throttle channel 31. In this embodiment, the dummy connecting throttle channel 34 and each return throttle channel 31 have the same channel cross-sectional area.

Such a dummy connecting throttle channel 34 is formed by the same process for the return throttle channels 31. The dummy connecting throttle channels 34 is formed in a half-etched plate. Thus, the dummy connecting throttle channel 34 and the return throttle channels 31 have the same depth. This prevents formation of a step in a depth direction between the dummy connecting throttle channel 34 and a return throttle channel 31.

Referring back to FIG. 2, the vibration plate 55 is stacked on the 14th channel plate 54 to cover upper openings of the pressure chambers 28. The vibration plate 55 may be integral with the 14th channel plate 54. In this case, each pressure chamber 28 is recessed from a lower surface of the 14th channel plate 54 in the stacking direction. An upper portion of the 14th channel plate 54, which is above each pressure chamber 28, functions as the vibration plate 55.

Each piezoelectric element 60 includes a common electrode 61, a piezoelectric layer 62, and an individual electrode 63 which are arranged in this order. The common electrode 61 entirely covers the vibration plate 55 via the insulating film 56. Each piezoelectric layer 62 is located on the common electrode 61 to overlap a corresponding pressure chamber 28. Each individual electrode 63 is provided for a corresponding pressure chamber 28 and is located on a corresponding piezoelectric layer 62. In this case, a piezoelectric element 60 is formed by an active portion of a piezoelectric layer 62, which is sandwiched by an individual electrode 63 and the common electrode 61.

Each individual electrode 63 is electrically connected to a driver IC. The driver IC receives control signals from a controller (not shown) and generates drive signals (voltage signals) selectively to the individual electrodes 63. In contrast, the common electrode 61 is constantly maintained at a ground potential.

In response to a drive signal, an active portion of each selected piezoelectric layer 62 expands and contracts in a surface direction, together with the two electrodes 61 and 63. Accordingly, the vibration plate 55 corporates to deform to increase and decrease the volume of a corresponding pressure chamber 28. A pressure for liquid ejection from a nozzle 21 is applied to the corresponding pressure chamber 28 depending on its volume.

<Liquid Flow>

Flow of liquid, such as ink, in the ink ejection head 20 in this embodiment will be described. The supply port 22*a* is connected to a subtank via a supply conduit (not shown), and the return port 23*a* is connected to the subtank via a return conduit (not shown). In this structure, when a pressure pump in the supply conduit and a negative-pressure pump in the return conduit are driven, liquid from the subtank passes through the supply conduit into the supply manifold 22, via the supply port 22*a*.

Meanwhile, liquid partially flows into the individual channels 64. In each individual channel 64, liquid flows from the supply manifold 22, via the first communication hole 25, into the supply throttle channel 26 and further flows from the supply throttle channel 26, via the second communication hole 27, into the pressure chamber 28. Then, liquid flows from an upper end to a lower end of the descender 29 in the stacking direction to enter the nozzle 21. When the piezoelectric element 60 applies an ejection pressure to the pressure chamber 28, liquid is ejected from a nozzle hole 21*a*.

A part of liquid having not been ejected from the nozzle hole 21*a* flows through the return throttle channels 31 and enter the return manifold 23 via the third communication holes 32. The remaining part of liquid having not been ejected from the nozzle hole 21*a* flows into the connecting throttle channels 33 while flowing through the return throttle channel 31, and then enter the return manifold 23 via the communication ports 33*a*. Liquid entering the return manifold 23 via the third communication hole 32 and via the communication ports 33*a* flows through the return manifold 23, exits from the return port 23*a* to an exterior, and returns, via the return conduit, to the subtank. Thus, liquid having not been ejected from the nozzles 21*a* circulates between the subtank and the individual channels 64.

As described above, the liquid ejection head 20 in this embodiment includes the connecting throttle channels 33 through each of which adjacent return throttle channels 31 communicate with each other such that the connecting throttle channels 33 and the return throttle channels 31 have the same channel resistance. In other words, the connecting throttle channels 33 and the return throttle channels 31 have the same channel cross-sectional area. Thus, a pressure wave generated upon application of an ejection pressure to a corresponding pressure chamber 28 is likely to be dispersed into and propagate to the connecting throttle channels 33, and is unlikely to be reflected in the channel. This may prevent intensive propagation of the pressure wave, via the return throttle channel 31, to the return manifold 23 which is a common channel. The pressure wave is prevented from intensively propagating to the return manifold 23 and thus is less likely to affect other nozzles 21 in ejection performance. This may sufficiently improve the stability in liquid ejection.

In this embodiment, through the connecting throttle channel 33, adjacent return throttles channels 31 communicate with each other so as to have the same channel resistance. This helps dispersion of the pressure wave to the connecting throttle channel 33, thereby further improving the liquid ejection stability.

In this embodiment, through the connecting throttle channel 33, portions of adjacent return throttle channels 31 communicate with each other. Each portion is offset from the center of the return throttle channel 31 toward the other end 31*a* in the longitudinal direction. Specifically, through the connecting throttle channel 33, downstream end portions of adjacent return throttle channels 31 communicate with each other. This may prevent turbulences generated by interference between a pressure wave propagating through the return throttle channel 31 and a reflected wave reflected by the first channel plate 41.

In this embodiment, the connecting throttle channels 33 are provided for the liquid ejection head 20 which includes the damper 24 between the supply manifold 22 and the return manifold 23. This may improve the stability in ejection performance while preventing interaction between the liquid pressure in the supply manifold 22 and the liquid pressure in the return manifold 23.

Further, in this embodiment, the connecting throttle channels 33 and the return throttle channels 31 have the same depth, thereby preventing formation of a step in the depth direction between a connecting throttle channel 33 and a return throttle channel 31. The pressure wave is smoothly dispersed from a return throttle channel 31 to a connecting throttle channel 33, without hitting any step.

Further, in this embodiment, the connecting throttle channels 33 are formed in the half-etched plate, without interference with other neighboring plates.

Further, in this embodiment, through the dummy connecting throttle channel 34, the return throttle channel 31 of the individual channel 35, which is located at an end of the nozzles 21 in the array direction, and the return throttle channel 31 of the dummy individual channel 35 communicate with each other. This structure allows dispersion of the pressure wave in the return throttle channel 31 at the end of the nozzles 21 in the array direction into the dummy connecting throttle channel 34. Thus, the pressure wave in the return throttle channel 31 located at the end of the nozzles 21 in the array direction is dispersed similarly to the pressure wave in each return throttle channel 31 located other than at the end. Adjacent two individual channels 31 at the end are configured together with the dummy connecting channel 34, similarly to adjacent two of other return throttle channels 31 near the center which communicate with each other through a corresponding return throttle channel 31. This makes uniform an ejection force either at the end or near the center.

Further, in this embodiment, each connecting throttle channel 33 has a communication port 33*a* connected to the return manifold 23, so as to efficiently return liquid.

Further, in this embodiment, the connecting throttle channels 33 are provided for the return throttle channels 31, which differs from those in a second illustrative embodiment to be described later. A liquid flow is generated by a pressure difference between a negative pressure caused by ejection and a pressure of a circulating liquid. This may prevent settlement and aggregation of components of liquid retained in the connecting throttle channels 33.

Second Illustrative Embodiment

A liquid ejection head 20A according to a second illustrative embodiment will now be described. In the second illustrative embodiment, similar elements to those in the first illustrative embodiment are given like reference characters and will not be described repeatedly, unless otherwise specified.

Unlike the first illustrative embodiment which provides the connecting throttle channels 33 through each of which adjacent return throttle channels 31 communicate with each other, the second illustrative embodiment provides connecting throttle channels 36 through each of which adjacent supply throttle channels 26 communicate with each other.

The connecting throttle channels 36 extend in an array direction. Through a connecting throttle channel 36, adjacent return throttle channels 26 communicate with each other so as to have the same channel resistance. Specifically, through the connecting throttle channel 36, portions of adjacent supply throttle channels 26 communicate with each other. Each portion is offset from a center of the supply throttle channel 26 toward one end 26*b* in a longitudinal direction. In other words, through the connecting throttle channel 36, upstream end portions of adjacent supply throttle channels 26 communicate with each other.

Each connecting throttle channel 36 has a channel resistance less than or equal to the channel resistance of each supply throttle channel 26. In this case, each connecting throttle channel 36 has a channel cross-sectional area less than or equal to the channel cross-sectional area of each supply throttle channel 26. In this embodiment, each connecting throttle channel 36 and each supply throttle channel 26 have the same channel cross-sectional area.

Such connecting throttle channels 36 are formed by the same process for the return throttle channels 26. The connecting throttle channels 36 are formed in a half-etched plate. Thus, the connecting throttle channels 36 and the supply throttle channels 26 have the same depth. This prevents formation of a step in a depth direction between a connecting throttle channel 36 and a supply throttle channel 26.

In this embodiment, a supply throttle channel 26 is located to cross a width direction in plan view. An angle between an extending direction of the supply throttle channel 26 and the width direction is set to be greater than 0° and less than 90°. Return throttle channels 31 are arranged parallel to the width direction in plan view. In other words, the return throttle channels 31 are arranged orthogonal to the array direction in plan view.

As described above, the liquid ejection head 20A in the second illustrative embodiment includes the connecting throttle channels 36 through each of which adjacent supply throttle channels 26 communicate with each other such that the connecting throttle channels 36 and the supply throttle channels 26 have the same channel resistance. In other words, the connecting throttle channels 36 and the supply throttle channels 26 have the same channel cross-sectional area. Thus, as in the liquid ejection head 20 in the first illustrative embodiment, a pressure wave generated upon application of an ejection pressure to a corresponding pressure chamber 28 is likely to be dispersed into and propagate to the connecting throttle channels 36, and is unlikely to be reflected in the channel. This may prevent intensive propagation of the pressure wave, via the supply throttle channel 26, to the supply manifold 22 which is a common channel. The pressure wave is prevented from intensively propagating to the supply manifold 22 and thus is less likely to affect other nozzles 21 in ejection performance. This may sufficiently improve the stability in liquid ejection.

Other Illustrative Embodiments

The disclosure may not be limited to the above-described embodiments, and various changes may be applied therein without departing from the spirit and scope of the disclosure.

Figure 6:
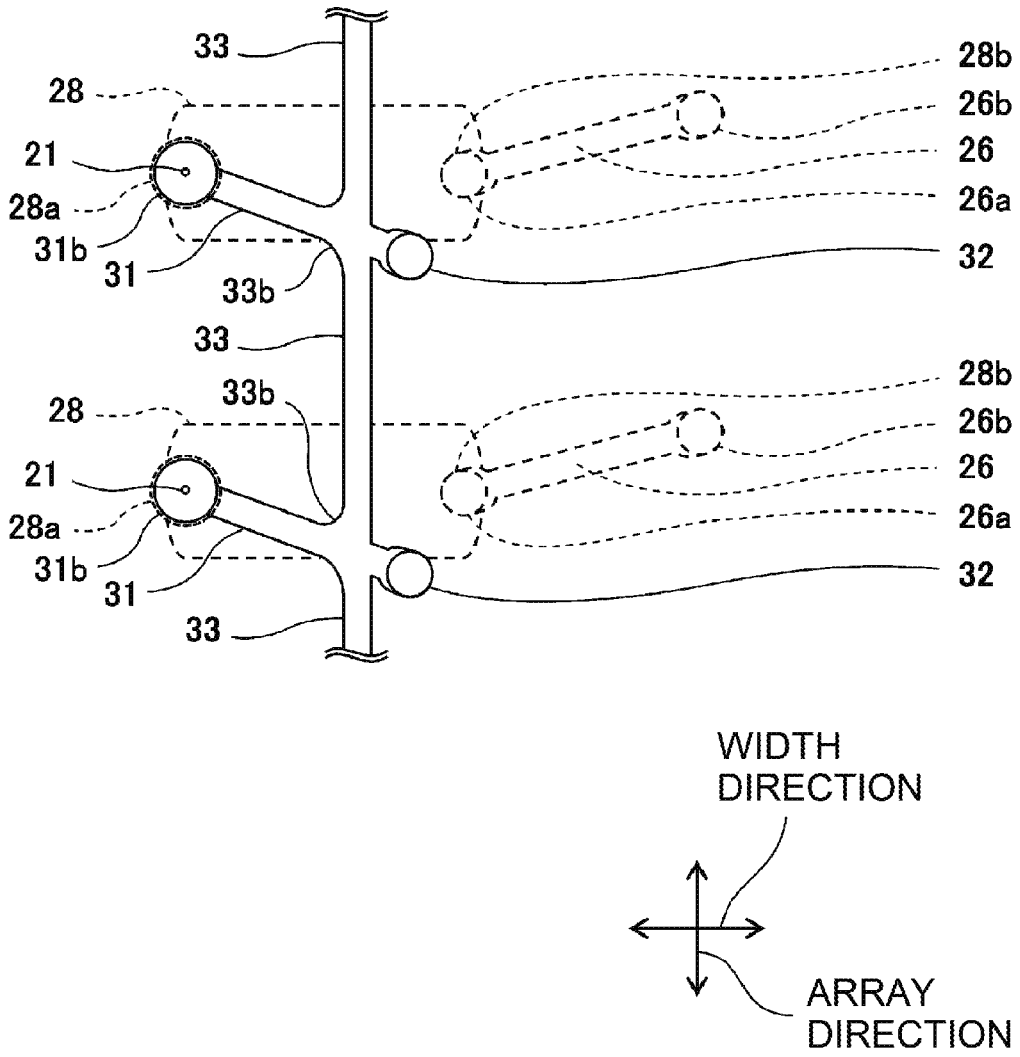
FIG. 6 is a plan view of connecting portions located between the return throttle channels and the connecting throttle channels and modified in shape from those in the first illustrative embodiment.

For example, as shown in FIG. 6, a connecting portion 33*b* between a return throttle channel 31 and a connecting throttle channel 33 may be round or curved in shape. This structure helps dispersion of the pressure wave to the connecting throttle channel 33.

Figure 7:
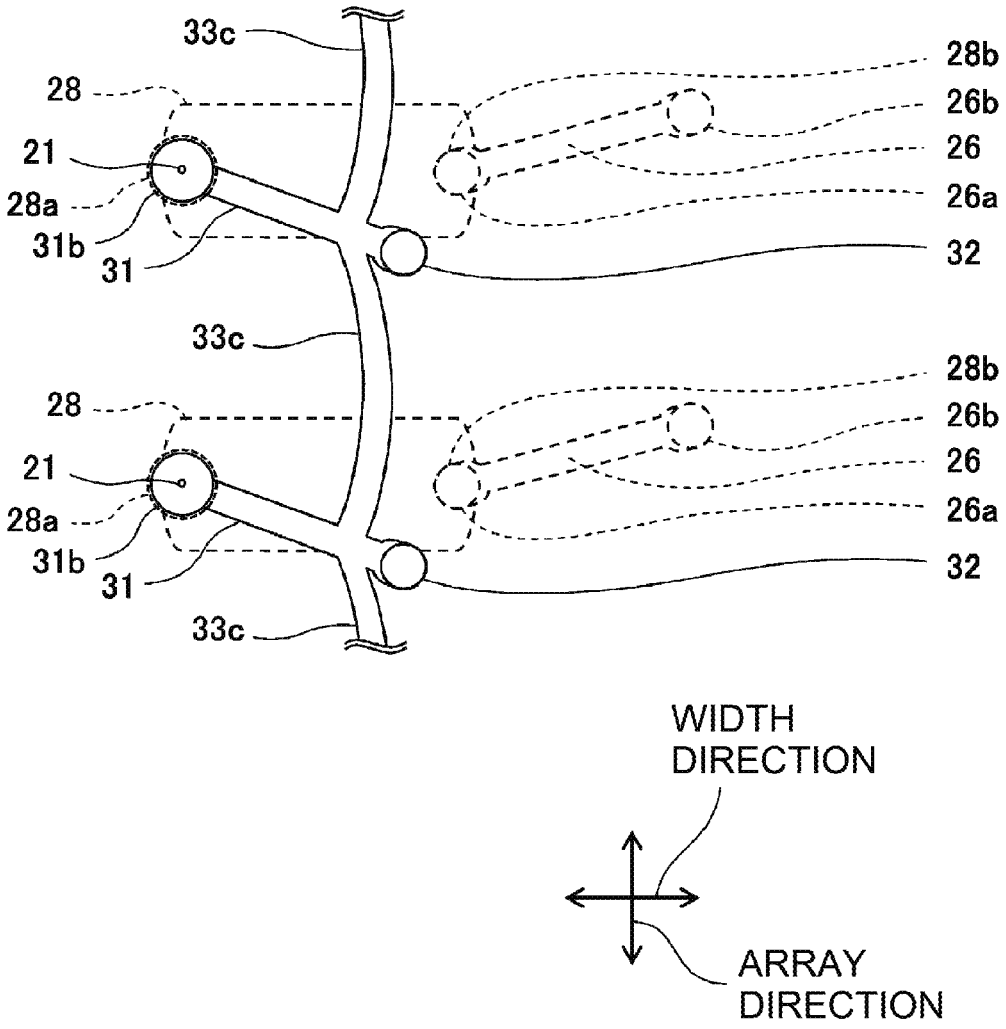
FIG. 7 is a plan view of connecting throttle channels modified in shape from those in the first illustrative embodiment.

In the first illustrative embodiment, the connecting throttle channels 33 extends in the array direction. However, as shown in FIG. 7, each connecting throttle channel 33*c* may be curved toward third communication holes 32. In this case, a pressure wave transmitting from a return throttle channel 31 to a third communication port 32 is likely to be dispersed into connecting throttle channels 33*c* and thus is less likely to be reflected.

In the first illustrative embodiment, the connecting throttle channels 33 are provided for the liquid ejection head 20 which includes the damper 24 between the supply manifold 22 and the return manifold 23. However, the connecting throttle channels 33 may be provided for a liquid ejection head without the damper 24. As in the first illustrative embodiment, such a structure disperses a pressure wave into the connecting throttle channels 33 and prevents intensive propagation of the pressure wave to a return manifold 23, thereby improving the ejection stability. Without the dumper 24, the liquid ejection head is reduced in thickness.

In the first illustrative embodiment, the connecting throttle channels 33 are provided for the return throttle channels 26, while, in the second illustrative embodiment, the connecting throttle channels 36 are provided for the supply throttle channels 26. In other words, the connecting throttle channels are provided for either the return throttle channels 31 or the supply throttle channels 26. However, the connecting throttle channels may be provided for both of the return throttle channels 31 and the supply throttle channels 26.

What is claimed is:

1. A liquid ejection head comprising:

a supply manifold including a supply port through which liquid is supplied from an exterior;

a return manifold including a return port through which liquid is discharged to the exterior;

a plurality of individual channels each connected, at an upstream end thereof, to the supply manifold and, at a downstream end thereof, to the return manifold, each of the individual channels communicating with a corresponding one of nozzles and including an individual throttle channel; and a connecting throttle channel through which adjacent ones of the individual throttle channels communicate with each other, wherein the connecting throttle channel has a channel resistance less than or equal to a channel resistance of each of the individual throttle channels.

2. The liquid ejection head according to claim 1, wherein the connecting throttle channel and the individual throttle channels have a same channel cross-sectional area.

3. The liquid ejection head according to claim 1, wherein through the connecting throttle channel, portions of the adjacent ones of the individual throttle channels communicate with each other, the portions having a same channel resistance.

4. The liquid ejection head according to claim 3, wherein through the connecting throttle channel, downstream portions of the adjacent ones of the individual throttle channels communicate with each other.

5. The liquid ejection head according to claim 1, wherein the supply manifold and the return manifold lack a damper therebetween, and wherein the connecting throttle channel is connected to the adjacent ones of the individual throttle channels connected to one of the supply manifold and the return manifold which lack the damper therebetween.

6. The liquid ejection head according to claim 1, wherein the supply manifold and the return manifold have a damper therebetween, and wherein the connecting throttle channel is connected to the adjacent ones of the individual throttle channels connected to one of the supply manifold and the return manifold which have the damper therebetween.

7. The liquid ejection head according to claim 1, wherein the connecting throttle channel and each of the adjacent ones of the individual throttle channels have a curved connecting portion therebetween.

8. The liquid ejection head according to claim 1, wherein the connecting throttle channel and the individual throttle channels have a same depth, and a top surface and a bottom surface of the connecting throttle channel are respectively level with top surfaces and bottom surfaces of the adjacent ones of the individual throttle channels.

9. The liquid ejection head according to claim 1, wherein the connecting throttle channel and the individual throttle channels are recessed grooves formed in a plate.

10. The liquid ejection head according to claim 1, wherein the connecting throttle channel is curved such that a central portion thereof is located more downstream than opposite ends thereof in a liquid flow direction in the individual throttle channels.

11. The liquid ejection head according to claim 1, further comprising:

a dummy individual channel located at an end of the nozzles arranged in an array to communicate with the supply manifold and the return manifold, the dummy individual channel having no nozzle and including a dummy individual throttle channel which has a same shape as the individual throttle channels; and a dummy connecting throttle channel through which the dummy individual channel communicates with one of the individual throttle channels which is located at the end of the array of the nozzles.

12. The liquid ejection head according to claim 1, wherein the connecting throttle channel includes a communication port in communication with the return manifold.

13. The liquid ejection head according to claim 1, wherein the individual throttle channels include return throttle channels each communicating with a corresponding pressure chamber communicating with the corresponding one of the nozzles, and adjacent ones of the return throttle channels communicate with each other through the connecting throttle channel.

* * * * *